United States Patent [19]

Galvin et al.

[11] 4,032,916

[45] June 28, 1977

[54] INTRUSION ALARM CABLE SUPERVISION SYSTEM

[75] Inventors: Aaron A. Galvin, Lexington; James B. Edson, Concord; James O. C. Bean, Boston, all of Mass.

[73] Assignee: American District Telegraph Company, New York, N.Y.

[22] Filed: May 27, 1975

[21] Appl. No.: 581,131

[52] U.S. Cl. ..... 340/409; 340/152 T; 340/255; 340/310 R; 340/408

[51] Int. Cl.[2] ..... G08B 29/00

[58] Field of Search ..... 340/409, 253 P, 258, 340/172.5, 310 R, 310 A, 224, 255, 408, 276, 152 I, 151, 147 SC, 274; 179/175.2 C

[56] References Cited

UNITED STATES PATENTS

| | | | |
|---|---|---|---|
| 2,817,074 | 12/1957 | Faulkner | 340/255 |
| 3,252,156 | 5/1966 | Muehter | 340/409 |
| 3,430,231 | 2/1969 | Weld | 340/409 |
| 3,641,547 | 2/1972 | Reiss et al. | 340/276 |
| 3,649,873 | 3/1972 | Vlack | 340/408 |
| 3,653,041 | 3/1972 | McGrath et al. | 340/253 R |
| 3,702,474 | 11/1972 | Fink et al. | 340/409 |
| 3,716,834 | 2/1973 | Adams | 340/409 |
| 3,786,501 | 1/1974 | Marnerakis | 340/409 |
| 3,828,313 | 8/1974 | Schull et al. | 340/151 |
| 3,846,793 | 11/1974 | Cook | 340/255 |
| 3,848,241 | 11/1974 | LeNay et al. | 340/408 |

*Primary Examiner*—Thomas B. Habecker
*Assistant Examiner*—Donnie L. Crosland
*Attorney, Agent, or Firm*—Weingarten, Maxham & Schurgin

[57] ABSTRACT

A cable supervision system especially adapted for use in an intrusion alarm installation and which is capable of monitoring at a central control unit all lines of an interconnection cable for proper signal levels and balance. Under intended cable signal conditions a predetermined sensible impedance is provided which is monitored at the control unit. A monitoring circuit is coupled to the end of a system cable remote from the control unit, this circuit being operative to monitor the signal conditions of all lines of the cable. In response to proper signal conditions on the cable as determined by this monitoring circuit a predetermined impedance is provided which is sensed at the control unit to detect a change in impedance which would signal a tamper or cable failure alarm.

8 Claims, 3 Drawing Figures

INTRUSION ALARM CABLE SUPERVISION SYSTEM

FIELD OF THE INVENTION

This invention relates to intrusion alarm systems and more particularly to a system for supervision of the signal conditions of a cable interconnecting a central control unit and one or more remote transceivers.

BACKGROUND OF THE INVENTION

Instrusion alarm systems are known for detecting the presence of an intruder in a zone under protection. In such systems, there is typically provided a central control unit and a plurality of remote transceivers each located in an area to be protected, the transceivers being interconnected by one or more multiwire cables to the control unit. The transceivers each include a transmitting and a receiving transducer and associated circuitry for propagating an energy pattern into the protected zone and for receiving signals returned therefrom. The central control unit includes signal processing circuitry for detection of intruder presence and for discriminating signals representative of intruder presence from spurious signals and noise. The cables interconnecting the transceivers with the control unit typically include a pair of lines carrying a balanced transmitter signal for the transmitting transducers, a shielded receiver line for conveying signals provided by the receiving transducers to the control unit for subsequent processing, and one or more tamper lines. The tamper line is usually connected in a closed loop from a transceiver to the control unit such that cutting of the tamper line is detectable as an alarm condition. Tampering with the lines other than the tamper line of the cable will not usually result in an alarm condition. In order to further enhance the security of an alarm system and particularly the interconnecting cables thereof, it would be preferable to monitor all wires of the system cabling to detect any tampering or changed signal conditions on any of the cable lines.

SUMMARY OF THE INVENTION

Briefly, the present invention provides a cable supervision system especially adapted for use in an intrusion alarm system and which is capable of monitoring all lines of an interconnection cable for proper signal conditions and for producing under intended signal conditions a predetermined sensible impedance. A monitoring circuit is coupled to the end of a system cable remote from a central control unit, this circuit being operative to monitor in typical embodiment the absolute line-to-line level of a balanced transmitter signal, the balance of the transmitter signal relative to ground, and the DC voltage on the receiver line. In response to proper signal conditions on the multiple wires of the cable as determined by the monitoring circuit, a predetermined impedance is provided between a tamper line and ground, which impedance is sensed at the control unit to detect an impedance change which would signal a tamper or cable failure alarm.

It should be understood that the term "cable" as used herein is not limited to a jacketed multiwire conductor but includes any multiwire conductive path which interconnects a central control unit and one or more remote transceivers of an alarm system.

DESCRIPTION OF THE DRAWINGS

The invention will be more fully understood from the following detailed description taken in conjunction with the accompanying drawings in which.

DETAILED DESCRIPTION OF THE INVENTION

Figure 1:
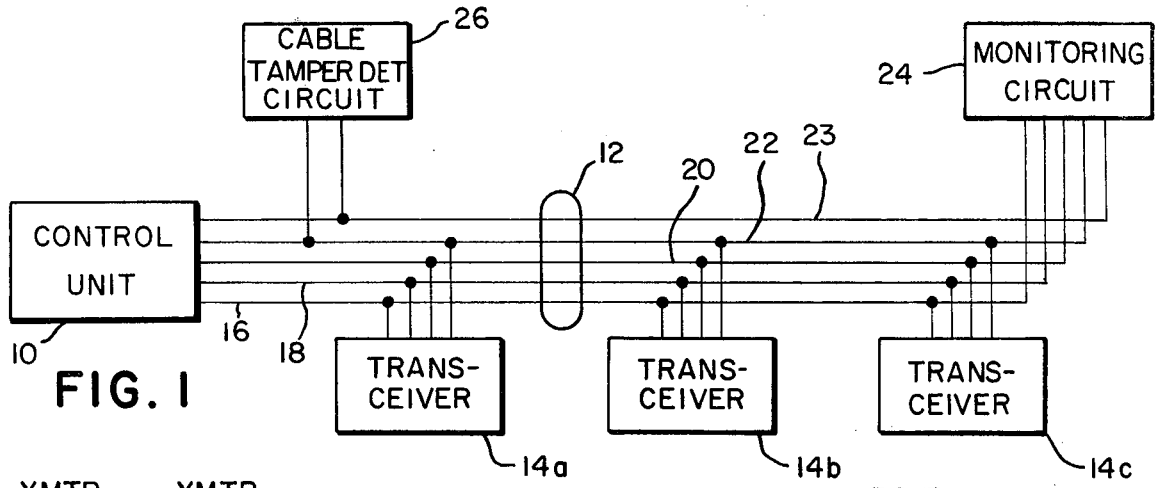
FIG. 1 is a diagrammatic representation of a cable supervision system according to the invention.

An intrusion alarm system employing a cable supervision system according to the invention is shown in diagrammatic form in FIG. 1. A control unit 10 is connected to a multiconductor cable 12 which extends to remote points of a system installation at which respective transceivers 14*a*, 14*b* and 14*c* are located and connected to cable 12. Each of the transceivers includes a transmitting transducer connected to the transmitter lines 16 and 18 of cable 12, and a receiving transducer and associated preamplifier connected to the receiving line 20 and ground line 22 of cable 12. The control unit includes signal processing circuitry for receiving signals returned by the respective transceivers and providing an output alarm indication upon detection of intruder presence. The signal processing circuitry also usually includes circuitry for discriminating between valid intruder signals and noise or other spurious signal conditions to minimize false alarms. The alarm system itself is not the subject of this invention, but can be of many different known configurations, a typical alarm system being shown in U.S. Pat. No. 3,665,413, assigned to the assignee of this invention.

According to the present invention, a monitoring circuit 24 is connected to the several lines of cable 12 at the end of the cable remote from control unit 10. A cable tamper detection circuit 26 is located at control unit 10 and is connected to the ground line 22 and the tamper line 23 of cable 12. The monitoring circuit 24 monitors the signal conditions on the lines of cable 12 and provides in response to proper signal conditions a predetermined impedance between the tamper and ground lines which is detected by circuit 26. Circuit 26 is operative to provide a tamper or cable failure alarm indication upon detection of change in the predetermined impedance beyond selected limits. In usual installation, circuit 24 is contained in the transceiver connected to the end of cable 12, while circuit 26 is contained in control unit 10.

Figure 2:
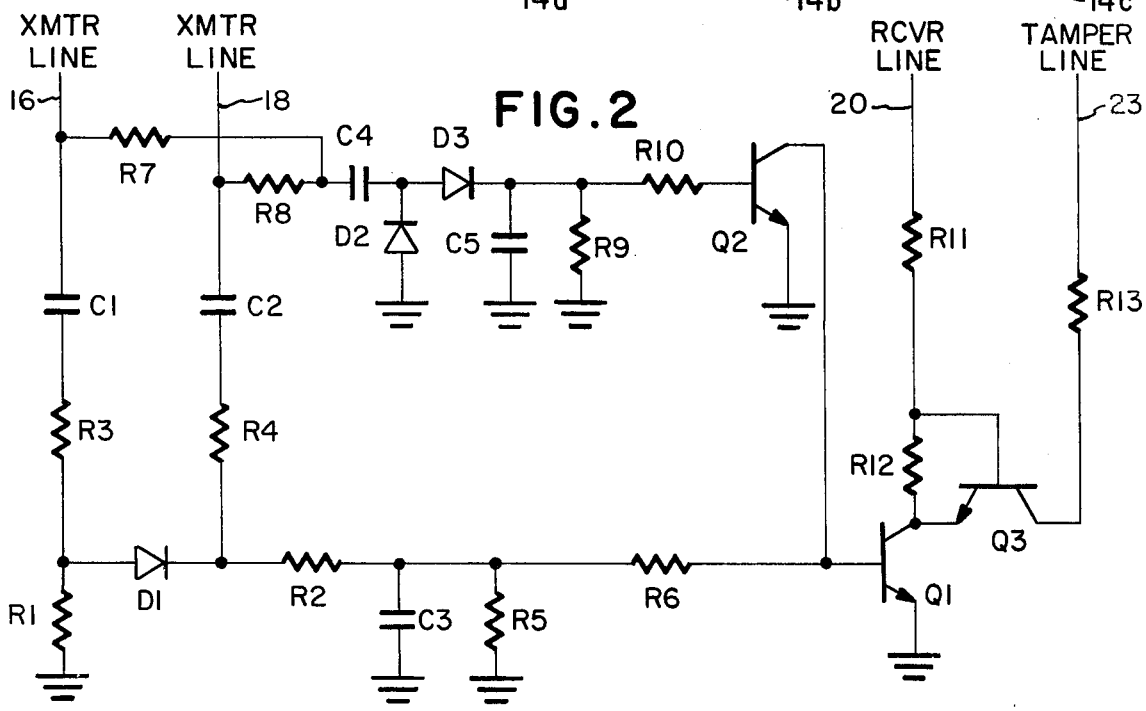
FIG. 2 is a schematic diagram of a monitoring circuit according to the invention.

The monitoring circuit 24 in typical implementation is shown schematically in FIG. 2. A detector, including capacitors C1, C2 and C3, resistors R1, R2, R3 and R4 and diode D1, connected as illustrated to the transmitter lines 16 and 18, detects the voltage across these transmitter lines, the detector output being developed across load resistor R5 and applied via resistor R6 to the base of transistor Q1. Transistor Q1 will be in the conducting state if the transmitter line-to-line AC voltage is above a selected minimum level and in a nonconducting state when the transmitter Ac voltage is below this level. Another detector, including diodes D2 and D3, capacitor C5 and resistor R9 is driven by the transmitter signals applied via resistors R7 and R8 and capacitor C4. By making the values of resistors R7 and R8 equal, this detector will respond only to the common mode component of the signals on the transmitter lines. The detector output is applied via resistor R10 to the base of transistor Q2. Transistor Q2 is in a non-conducting state when the common mode transmitter signal is below a selected level and in a conducting state when the transmitter signal is above this level. If the imbalance of the transmitter signals exceeds a predetermined level, transistor Q2 is caused to conduct, in turn causing transistor Q1 to become non-conducting.

The receiver line 20 is connected via resistor R11 to the base of transistor Q3 and to the emitter of transistor Q3 via series connected resistor R12. The collector of transistor Q3 is connected by way of an impedance, in this case resistor R13, to tamper line 23. The DC signal, normally present on the receiver line, maintains transistor Q3 in a conducting state. If the signal on the receiver line falls below a predetermined level, the transistor Q3 becomes nonconducting. Thus, under normal operating conditions, transistors Q1 and Q3 are conducting and the collector of transistor Q3 is therefore maintained at nearly DC ground potential. At the control unit end of cable 12, the resistance between tamper line 23 and ground is determined essentially by the resistance value of resistor R13, this value being monitored by circuit 26 to assure cable integrity and the presence of proper signal conditions on the cable. If tamper line 23 is short circuited or broken, the resistance value being monitored will change, which change can cause provision of a tamper or cable failure alarm by circuit 26. If the receiver line 20 is cut or short circuited, transistor Q3 will become nonconductive, causing change in the sensible resistance by circuit 26. If either transmitter line 16 or 18 is cut or short circuited, either transistor Q1 will lose its base drive and become non-conductive, or transistor Q2 will become conductive, causing turn-off off transistor Q1. If both transmitter lines are cut, the same will result. The system will also detect a partial short or open circuit condition sufficient to cause a sensible change in impedance being monitored.

It will be appreciated that the circuit of FIG. 2 is operative to denote the cutting or short circuiting of any line of the system cable. In typical implementation, the tamper line 23 is connected in series with tamper switches provided as interlocks with the case or housing of the transceivers, such that opening of a transceiver housing causes interruption of current flow in the tamper line with consequent provision of a tamper alarm.

Figure 3:
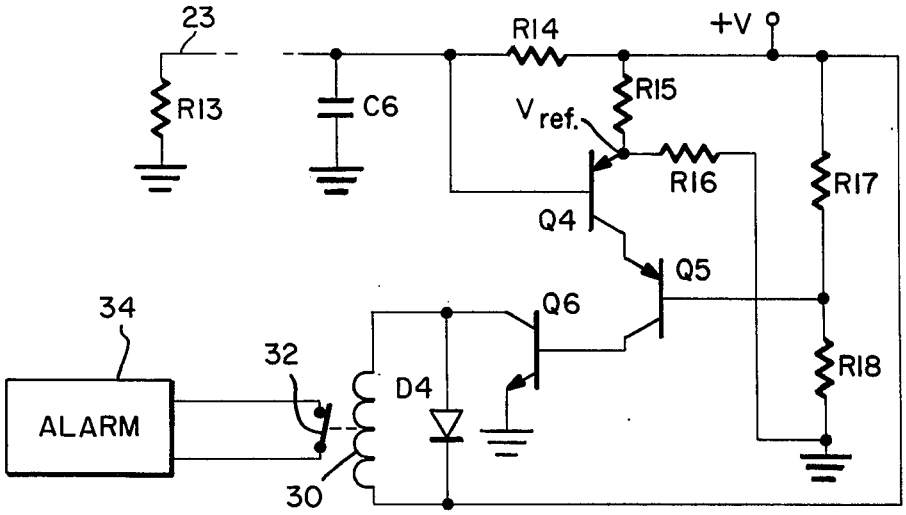
FIG. 3 is a schematic diagram of a cable tamper detection circuit according to the invention.

The cable tamper detection circuit 26 is shown in a typical embodiment in FIG. 3. The tamper line 23 is connected to the base of transistor Q4, the emitter of which is coupled via a resistor R15 to a source of positive voltage +V. A resistor R14 is connected between resistor R15 and the base of transistor Q4, while a resistor R16 is connected from the emitter of transistor Q4 to ground potential. The transistor Q4 functions as a comparator wherein a reference voltage is provided at the junction of resistors R15 and R16. The comparator output provided at the collector of transistor Q4 is applied to an amplifier including direct coupled transistors Q5 and Q6. The base voltage for transistor Q5 is developed by series connected resistors R17 and R18. The collector of transistor Q6 is connected to a relay coil having a protective diode D4 in shunt thereacross. The contacts 32 of the relay are connected to an alarm circuit 34 operative to provide an output indication of a tamper or cable failure alarm.

In the presence of proper signal conditions on cable 12, a predetermined impedance determined essentially by resistor R13 (FIG. 2) is provided and which is sensed by the circuit of FIG. 3. In the presence of this intended resistance, transistor Q4 is caused to conduct, in turn causing conduction of transistors Q5 and Q6. The relay 30 is thus energized maintaining contacts 32 in closed condition. In the event that the predetermined resistance is increased beyond a selected amount, such as by cutting or short circuiting of any of the lines of the interconnecting cable, the transistors Q4, Q5 and Q6 become non-conducting causing de-energization of relay 30 and opening of contacts 32, thereby triggering an output indication of an alarm condition by alarm circuit 34. If the predetermined resistance decreases beyond a selected amount, the base voltage of transistor Q4 decreases, thus also decreasing the emitter voltage of transistor Q5. When the emitter voltage of transistor Q5 decreases below the value, as set by resistors R17 and R18, necessary to maintain conduction of transistor Q5, this transistor and thus transistor Q6 become non-conducting, triggering an alarm condition denoted by alarm circuit 34.

Thus, according to the invention, each line of an interconnecting cable is continuously monitored at the control unit to provide immediate detection of a failure or tampering with the cable to signal an appropriate alarm. The illustrative embodiment described above employs a DC sensing technique having a resistive termination. Alternatively, AC sensing techniques can be employed as can combined AC and DC sensing. The terminating impedance may be resistive, reactive or a combination thereof. It will be appreciated that the invention is not limited to the specific cable configuration shown, but rather can be employed with many different multiwire configurations. The cable in simplest form can be of three wires; a transmitter line, a receiver line and ground. In this event, one of the lines, typically the transmitter line, could also serve as the tamper line carrying a DC current for tamper purposes as well as the AC transmitter signal. Accordingly, it is not intended to limit the invention by what has been particularly shown and described except as indicated in the appended claims.

What is claimed is:

1. For use in an intrusion alarm system having a control unit and at least one transceiver interconnected in parallel to a single multiconductor cable having a transmitter line, a receiver line, a tamper line, and a ground line, a first end of said cable being connected to said control unit, a cable supervision system comprising:

a monitoring circuit coupled to the second end of said cable remote from said control unit and including:

a first circuit connected to the transmitter line and operative to monitor at least one signal condition thereon;

a second circuit connected to the receiver line and operative to monitor a signal condition thereon; and a third circuit connected to the tamper and ground lines and providing a predetermined impedance only under proper signal conditions sensed on said cable by said first and second circuits;

detector means at the first end of said cable opposite to said monitoring circuit connected to said tamper and ground lines and operative to detect a change in said predetermined impedance; and alarm means coupled to said detector means and operative to provide an output signal indication of an alarm condition when the detected change in impedance exceeds a predetermined threshold level.

2. The invention according to claim 1 wherein said transmitter line includes at least two tranmitter conductors and wherein said first circuit includes circuit means operative to monitor the transmitter voltage on said transmitter line, and circuit means operative to monitor the signal balance of the transmitter voltage.

3. The invention according to claim 2 wherein said first circuit includes:

means connected to the conductors of said cable serving as a balanced transmitter line and operative to detect the transmitter voltage across this balanced transmitter line;

first switching means conductive when the transmitter voltage on said balanced line is above a selected minimum level and non-conductive when the transmitter voltage on said balanced line is below said selected minimum level;

means connected to said balanced transmitter line and providing a signal representative of an unbalanced transmitter voltage on said balanced line;

second switching means non-conductive when said signal is is below a selected level and conductive when said signal is above said selected level;

said second switching means being coupled to said first switching means such that said first switching means is non-conductive when said second switching means is conductive;

and wherein said second circuit includes third switching means coupled to the receiver line and conductive when the DC signal on said receiver line is above a predetermined level and non-conductive when said signal on said receiver line is below said predetermined level.

4. The invention according to claim 1 wherein said detector means includes comparator means having an input coupled to said tamper and ground lines and a predetermined reference threshold and providing an output signal in response to detection of said predetermined impedance.

5. The invention according to claim 1 wherein said detector means includes:

first transistor means coupled to said tamper line and including means providing a reference voltage thereto;

said first transistor means providing an output signal in the presence of said predetermined impedance;

second transistor means operative to amplify the output signal from said first transistor means; and relay means energized in response to said amplified output signal from said second transistor means and de-energized by the absence of said amplified output signal to cause activation of said alarm means.

6. The invention according to claim 3 wherein said third circuit includes:

an impedance element in circuit with said tamper line; and switching means coupling said impedance element to said ground line under proper signal conditions sensed on said cable.

7. For use in an intrusion alarm system having a control unit and a plurality of transceivers connected in parallel to a multiconductor cable having a transmitter line of at least one conductor, a receiver line, a tamper line, and a ground line, the control unit being connected to a first end of said cable, a cable supervision system comprising:

a monitoring circuit coupled to each of the conductors of said cable at the second end of the cable remote from said control unit and including:

a first circuit connected to the at least one conductor of said cable serving as the transmitter line and operative to monitor the transmitter voltage on said transmitter line;

a second circuit connected to the receiver line of said cable and operative to monitor the level of a DC signal thereon; and a third circuit connected to the tamper and ground lines and providing a predetermined impedance under proper signal conditions sensed on said transmitter and receiver lines by said first and second circuits;

detection means at the first end of said cable opposite to said monitoring circuit and connected to the conductors of said cable serving as said tamper and ground lines and operative to provide an output signal indication upon detection of a predetermined change in said impedance.

8. For use in an intrusion alarm system having a control unit and a plurality of transceivers connected in parallel to a single multiwire cable having at least three separate wires including a tamper line and a ground line, the first end of said cable being connected to said control unit, a supervision system comprising:

a monitoring circuit coupled to all of the wires of said path at the second end of said cable and operative to monitor at least one signal condition on each of the wires of said cable and including:

circuit means coupled to the wires of said path serving as the tamper line and the ground line and operative to provide a predetermined impedance therebetween only under conditions of simultaneous presence of normal alarm system signals and absence of signals indicating cable conductor short-circuits or open-circuits;

detector means at said first end of said cable coupled to the wires of said cable serving as said tamper and ground lines and operative to detect a change in said predetermined impedance therebetween; and alarm means coupled to said detector means and operative to provide an output signal indication of an alarm condition when the detected change in impedance exceeds a predetermined threshold level.

* * * * *